US010351386B2

(12) United States Patent
Peterson et al.

(10) Patent No.: US 10,351,386 B2
(45) Date of Patent: Jul. 16, 2019

(54) SYSTEM AND METHOD OF INITIATING ELEVATOR SERVICE BY ENTERING AN ELEVATOR CALL

(71) Applicant: Otis Elevator Company, Farmington, CT (US)

(72) Inventors: Eric C. Peterson, East Longmeadow, MA (US); Ashley Chapman, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 22 days.

(21) Appl. No.: 15/511,217

(22) PCT Filed: Sep. 10, 2015

(86) PCT No.: PCT/US2015/049452

§ 371 (c)(1),
(2) Date: Mar. 14, 2017

(87) PCT Pub. No.: WO2016/044061

PCT Pub. Date: Mar. 24, 2016

(65) Prior Publication Data

US 2017/0305716 A1 Oct. 26, 2017

Related U.S. Application Data

(60) Provisional application No. 62/050,606, filed on Sep. 15, 2014.

(51) Int. Cl.
*B66B 1/16* (2006.01)
*B66B 1/46* (2006.01)

(52) U.S. Cl.
CPC ..... *B66B 1/468* (2013.01); *B66B 2201/4615* (2013.01); *B66B 2201/4646* (2013.01); *B66B 2201/4653* (2013.01)

(58) Field of Classification Search
CPC ..... B66B 1/468; B66B 2201/4615; B66B 2201/4646; B66B 2201/4653
(Continued)

(56) References Cited

U.S. PATENT DOCUMENTS 7,377,364 B2 5/2008 Tyni et al.
8,047,333 B2 11/2011 Finschi
(Continued)

FOREIGN PATENT DOCUMENTS

CN 102452591 A 5/2012
CN 103538980 A 1/2014
(Continued)

OTHER PUBLICATIONS

"Kone RemoteCall, Smartphone Application for Kone Polaris 900 Destination Control System," 2013.*
(Continued)

*Primary Examiner* — Jeffrey Donels
(74) *Attorney, Agent, or Firm* — Cantor Colburn LLP

(57) ABSTRACT

The present disclosure relates generally to a system and method of initiating elevator service by entering an elevator call with a call input device operating a program including a plurality of graphical objects displayed on a graphic user interface, in communication with an elevator system. The method includes the steps: selecting a first floor graphical object from the plurality of graphical objects; and selecting a second floor graphical object from the plurality of graphical objects.

21 Claims, 3 Drawing Sheets

(58) Field of Classification Search
USPC ..... 187/380
See application file for complete search history.

(56) References Cited

U.S. PATENT DOCUMENTS

| | | | | |
|---|---|---|---|---|
| 8,136,636 | B2 | 3/2012 | Bahjat et al. | |
| 8,336,678 | B2 | 12/2012 | Poutiainen et al. | |
| 8,520,900 | B2 | 8/2013 | Rhoads et al. | |
| 9,731,934 | B2 * | 8/2017 | Stanley | B66B 1/2408 |
| 2011/0122081 | A1 | 5/2011 | Kushler | |
| 2012/0048655 | A1 | 3/2012 | Hsu | |
| 2012/0305304 | A1 | 12/2012 | Kato et al. | |
| 2013/0084797 | A1 | 4/2013 | Avadhanam et al. | |
| 2013/0104090 | A1 | 4/2013 | Yu et al. | |
| 2013/0145448 | A1 | 6/2013 | Newell | |
| 2014/0014444 | A1 | 1/2014 | Kauppinen et al. | |
| 2014/0131142 | A1 | 5/2014 | Parkkinen et al. | |
| 2014/0131143 | A1 * | 5/2014 | Salmikuukka | B66B 1/468 187/391 |
| 2015/0068848 | A1 * | 3/2015 | Stanley | B66B 1/468 187/384 |
| 2017/0174473 | A1 * | 6/2017 | Simcik | B66B 1/468 |
| 2017/0313546 | A1 * | 11/2017 | King | B66B 1/2491 |
| 2017/0355556 | A1 * | 12/2017 | Simcik | B66B 1/468 |
| 2018/0118509 | A1 * | 5/2018 | Simcik | B66B 1/468 |
| 2018/0118510 | A1 * | 5/2018 | Simcik | B66B 1/468 |
| 2018/0121072 | A1 * | 5/2018 | Baldi | H04W 4/029 |

FOREIGN PATENT DOCUMENTS

| | | | |
|---|---|---|---|
| CN | 102381593 | B | 3/2014 |
| CN | 103803360 | A | 5/2014 |
| EP | 2730530 | A1 | 5/2014 |
| JP | 2005231755 | A | 9/2005 |
| KR | 101145739 | B1 | 5/2012 |
| WO | 2006011876 | A1 | 2/2006 |
| WO | 2011102654 | A2 | 8/2011 |
| WO | 2014086691 | A1 | 6/2014 |
| WO | 2014116182 | A1 | 7/2014 |

OTHER PUBLICATIONS

European Patent Office, International Search Report, dated Nov. 11, 2015.
European Patent Office, Written Opinion of the International Searching Authority, dated Nov. 11, 2015.
Chinese First Office Action with English Translation for Application No. 201580049770.8; Application Date: Sep. 10, 2015; dated Jul. 24, 2018; 18 pgs.

* cited by examiner

SYSTEM AND METHOD OF INITIATING ELEVATOR SERVICE BY ENTERING AN ELEVATOR CALL

CROSS REFERENCE TO RELATED APPLICATIONS

The present application is a U.S. national stage of, and claims the priority benefit of, International Patent Application Serial No. PCT/US2015/049452, filed Sep. 10, 2015 and also claims the priority benefit of U.S. Provisional Patent Application Ser. No. 62/050,606 filed Sep. 15, 2014, the contents of which are hereby incorporated in their entirety into the present disclosure.

TECHNICAL FIELD OF THE DISCLOSED EMBODIMENTS

The present disclosure is generally related to elevator systems and, more specifically, a system and method for initiating elevator service by entering an elevator call.

BACKGROUND OF THE DISCLOSED EMBODIMENTS

Entering an elevator call from a location away from the elevator provides convenience to a user to allow an elevator car to be potentially ready once the user arrives at the elevator doors. Generally, initiating an elevator call remotely requires an inconvenient and cumbersome process of a user using a mobile device to scroll and/or input an appropriate source and destination landing; then, possibly confirming that the selections made are correct. There is therefore a need for a more intuitive, convenient, and faster method of initiating an elevator call.

SUMMARY OF THE DISCLOSED EMBODIMENTS

In one aspect, a system for initiating elevator service is provided. The system includes an elevator system and a call input device in communication with the elevator system. In one embodiment, the call input device includes a mobile device. The call input device includes a processor, memory, and a graphical user interface. In one embodiment, the graphical user interface includes a touch screen display. A program stored in the memory operates to display a plurality of graphical objects on the touchscreen display. The program is further configured to initiate a call to the elevator system by allowing a user to select at least one of the plurality of graphical objects. In one embodiment, at least one of the plurality of graphical objects includes a floor graphical object. In one embodiment, the floor graphical object is moveable. In one embodiment, at least one of the plurality of graphical objects includes at least one trip graphical object.

In one aspect, a method of initiating elevator service by entering an elevator call on a call input device operating a program including a plurality of graphical objects displayed on a touchscreen display is provided. The method includes the steps of selecting a first floor graphical object from the plurality of graphical objects. In one embodiment, selecting the first floor graphical object includes touching the first floor icon at least once with an object. In one embodiment, selecting the first floor graphical object includes initiating a voice command with the call input device. In one embodiment, the selected first floor graphical object designates the source landing of the user. In one embodiment, the program may suggest a first floor graphical object for selection based at least in part on the user's travel history and/or anticipated travel.

After selection of the first floor graphical object, the method proceeds to the step of selecting a second floor graphical object from the plurality of graphical objects. In one embodiment, the selected second floor graphical object designates the desired destination landing of the user. In one embodiment, selecting the second floor graphical object includes moving the first floor graphical object such that the first floor graphical object overlays the desired second floor graphical object.

In one embodiment, selecting the second floor graphical object includes touching the second floor graphical object at least once with an object. In one embodiment, selecting the second floor graphical object includes initiating a voice command with the call input device. In one embodiment, the program may suggest a second floor graphical object for selection based at least in part on the user's travel history and/or anticipated travel.

The method further includes the step of selecting a trip graphical object from the plurality of graphical objects. In one embodiment, the at least one trip graphical object includes a return trip graphical object. In one embodiment, the program may suggest a trip graphical object for selection based at least in part on the user's travel history and/or anticipated travel.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
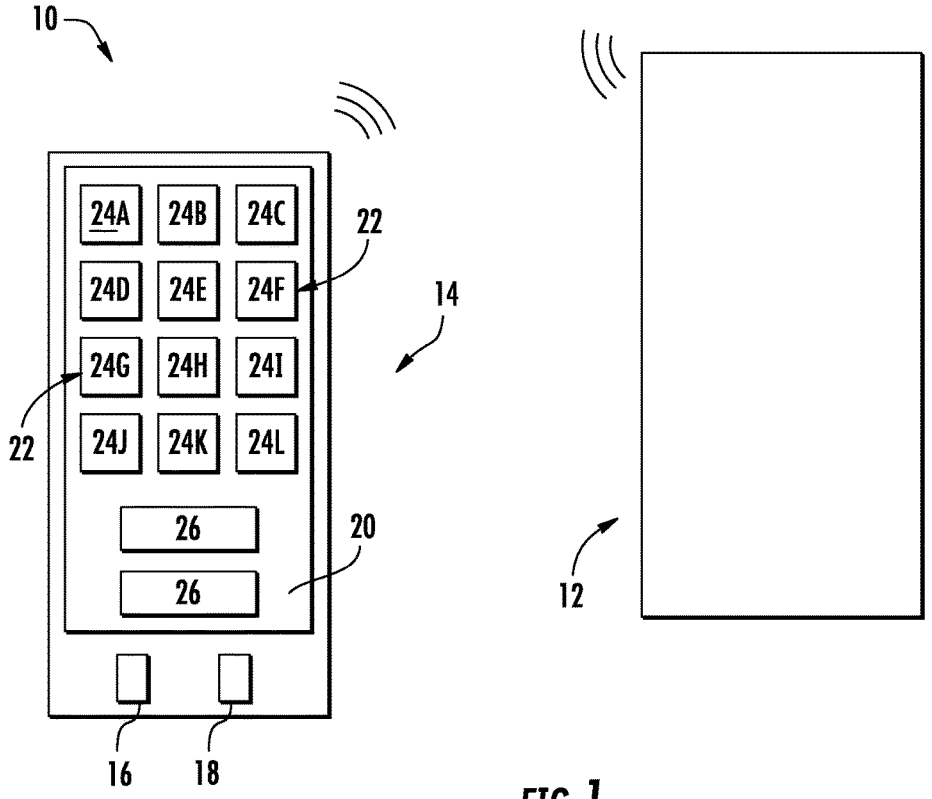
FIG. 1 is a schematic diagram of a system for initiating elevator service.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates a system for initiating elevator service, generally indicated at 10. The system 10 includes an elevator system 12 and a call input device 14 in communication with the elevator system 12. In one embodiment, the call input device 14 includes a mobile device. It will be appreciated that the call input device 14 may be any mobile device specifically suited for this purpose, for example, a mobile telephone, tablet device, or any device capable of being carried by a person outside of a home to name a few non-limiting examples. It will be appreciated that a communication module (not shown) is located within each of the elevator system 12 and the call input device 14 to enable wireless communication between the elevator system 12 and the call input device 14. The call input device 14 includes a processor 16, memory 18, and a graphical user interface 20. In one embodiment, the graphical user interface 20 includes a touch screen display. A program stored in memory 18 operates to display a plurality of graphical objects 22 on the graphical user interface 20. It will be appreciated that the plurality of graphical objects 22 need not fit on one page of the screen, and may occupy multiple pages on the display. It will also be appreciated that the plurality of graphical objects 22 may be on a current page and accessible via a scrolling action on the display. The program is further configured to initiate a call to the elevator system 12, as described in the method of FIG. 2, by allowing a user to select at least one of the plurality of graphical object 22. In one embodiment, at least one of the plurality of graphical objects 22 includes a floor graphical object 24. In one embodiment, the floor graphical object 24 is moveable. In one embodiment, at least one of the plurality of graphical objects 22 includes at least one trip graphical object 26.

The system 10 additionally also comprises up-down call buttons (not shown) as are normally used for the input of traditional landing calls, and car call buttons inside the elevator car. Those passengers who have a call input device 14 use it to summon the elevator car to where the user is located and place a call to another landing. Other passengers give a landing call in the traditional manner by pressing the up-down call buttons and a car call via the car operating panel.

When a user carrying a call input device 14 initiates elevator service, the call input device 14 and the elevator system 12 establish a connection permitting data transfer. When the user initiates the call, by the method presented in FIG. 2, a communication cycle is started between the call input device 14 and the elevator system 12.

Figure 2:
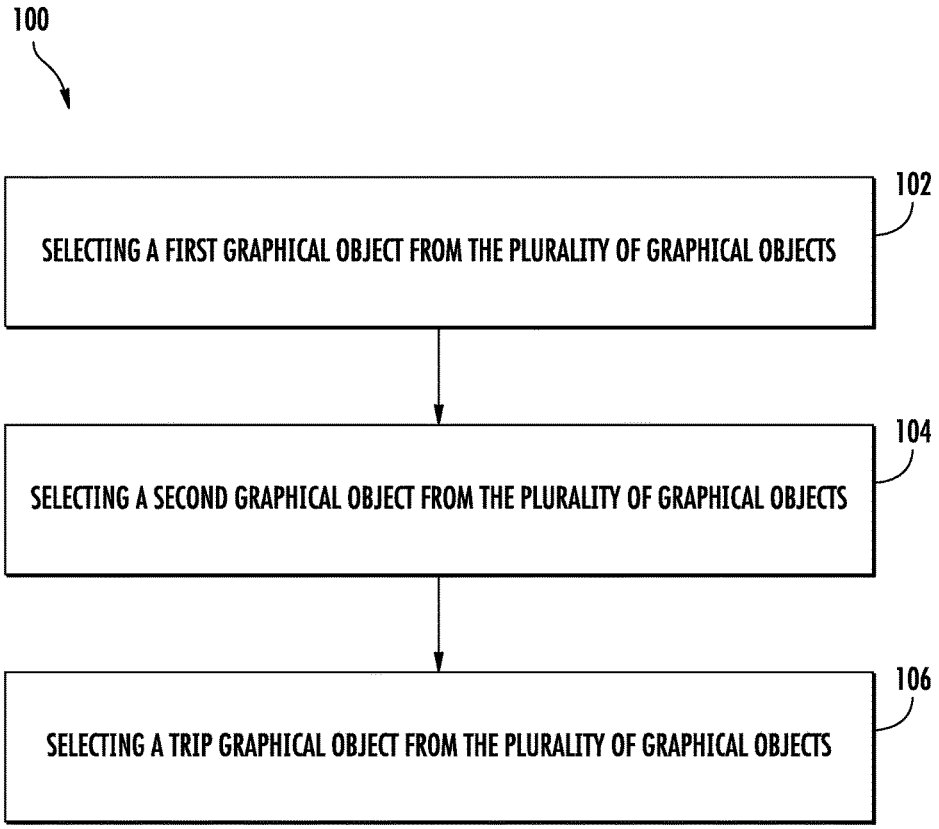
FIG. 2 is a schematic flow diagram of a method for initiating elevator service by initiating an elevator call.
Figure 3A:
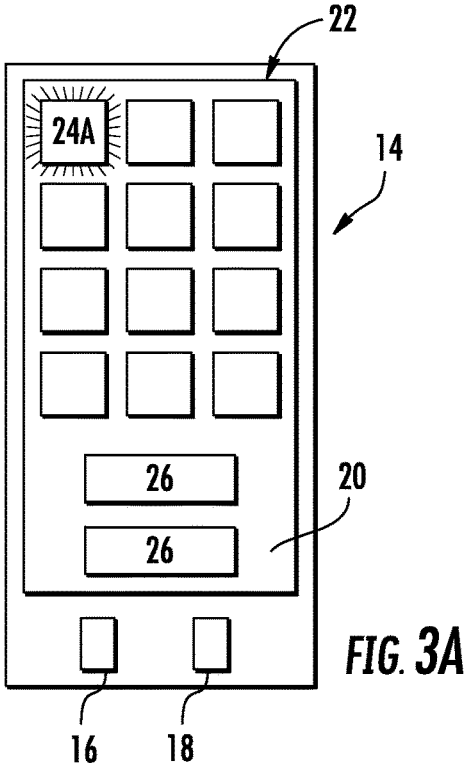
FIGS. 3A-3C are schematic diagrams of a call input device.

FIG. 2 illustrates a method 100 for initiating an elevator call using the system 10. The method includes the step 102 of selecting a first floor graphical object 24 from the plurality of graphical objects 22. In one embodiment, selecting the first floor graphical object 24 includes touching the first floor graphical object 24D at least once with an object (not shown). In one embodiment, selecting the first floor graphical object 24 includes initiating a voice command with the call input device 14 to select the first floor graphical object 24D. It will be appreciated that the object may include any object that may be detectable by the touchscreen display 20, such as a finger or stylus to name two non-limiting examples. In one embodiment, the selected first floor graphical object 24 designates the source landing of the user. For example, the user operates the program on the call input device 14 to initiate an elevator call; the user selects the source floor in which the user is currently located. If the user is located on the fourth floor of a building, the user selects the floor graphical object 24 displayed on the graphical user interface 20 designating the fourth floor. In one embodiment, the program may suggest a first floor graphical object 24 for selection based at least in part on the user's travel history and/or anticipated travel. For example, as shown in FIG. 3A, if the user typically initiates an elevator call from the first floor around 8 am, the program may suggest the first floor graphical object 24 designated as the first landing by illuminating or shading the first floor graphical object 42 in a different color to name a couple of non-limiting examples.

Figure 3B:
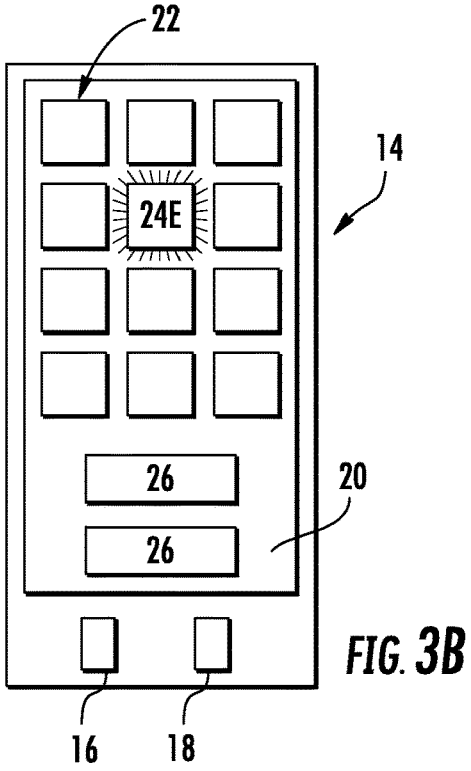

After selection of the first floor graphical object 24, the method proceeds to step 104 of selecting a second floor graphical object 24 from the plurality of graphical objects 22. In one embodiment, the selected second floor graphical object 24 designates the desired destination landing of the user. In one embodiment, selecting the second floor graphical object 24 includes moving the first floor graphical object 24 such that the first floor graphical object 24 overlays the desired second floor graphical object 24. For example, if the user desires to move from the fourth floor to the ninth floor, the user moves the floor graphical object 24D designated for the fourth floor until the first floor graphical object 24D overlays the second floor graphical object 24I designated for the ninth floor. In one embodiment, selecting the second floor graphical object 24 includes touching the second floor graphical object 24 at least once with an object. In one embodiment, selecting the second floor graphical object 24 includes initiating a voice command with the call input device 14. In one embodiment, the program may suggest a second floor graphical object 24 for selection based at least in part on the user's travel history and/or anticipated travel. For example, as shown in FIG. 3B, if the user typically initiates an elevator call to travel to the first floor around 12 pm, the program may suggest the second floor graphical object 24 designated as the first landing by illuminating or shading the second floor graphical object 24 in a different color to name a couple of non-limiting examples.

The method 100 further includes the step 106 of selecting a trip graphical object 26 from the plurality of graphical objects 22. After selection of the second floor graphical object 24, the program is configured to create at least one trip graphical object 26. The at least one trip graphical object 26 stores the recent selections of the user to allow for quick access to the travel history of the user. For example, if the user selected a first floor icon 24D designating the fourth floor and a second floor graphical object 24I designating the ninth floor, the program creates a trip graphical object 26 designating travel in the up direction from the fourth floor to the ninth floor. It will be appreciated that the program may create a trip graphical object in the down direction if the source floor is higher than the desired destination landing.

Figure 3C:
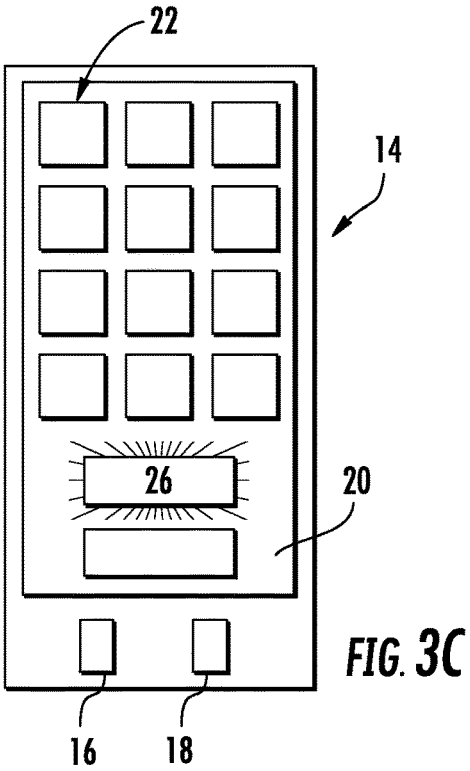

In one embodiment, the at least one trip icon 26 includes a return trip graphical object. For example, if the user selected a first floor icon 24D designating the fourth floor and a second floor graphical object 24I designating the ninth floor, the program creates a return trip graphical object 26 designating the ninth floor as the source landing with a down direction call to the fourth floor as the desired destination landing. This allows the user to initiate a faster elevator call without the need to select a first floor graphical object and a second floor graphical object. In one embodiment, the program may suggest a trip graphical object 26 for selection based at least in part on the user's travel history and/or anticipated travel. For example, as shown in FIG. 3C, if the user typically initiates an elevator call to travel from the first floor to the fifth floor to begin the work day around 8 am, the program may suggest a trip graphical object 26 with an up direction travel from the landing designated as the first floor to the landing designated as the fifth floor.

It will be appreciated that a user may conveniently initiate elevator service from a call input device 14 by selecting a first floor graphical object 24 and a second floor graphical object 24 from a plurality of graphical objects 22 displayed on a graphical user interface 20.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A method for initiating elevator service by entering an elevator call on a call input device operating a program including a plurality of graphical objects displayed on a graphical user interface, the method comprising the steps:
   selecting a first floor graphical icon from the plurality of graphical objects;
   suggesting, by the call input device, at least one second floor graphical object; and
   selecting, based at least in part on the suggesting, a second floor graphical icon from the plurality of graphical objects.

2. The method of claim 1, wherein the call input device comprises a mobile device.

3. The method of claim 1, wherein the graphical user interface comprises a touch screen display.

4. The method of claim 1, wherein each of the plurality of graphical objects are moveable.

5. The method of claim 1, further comprising:
   creating at least one trip graphical object; and
   selecting the at least one trip graphical object.

6. The method of claim 1, wherein selecting the first floor graphical object comprises at least one of:
   designating a user's location at a source landing;
   touching the first floor graphical object at least once with an object; and
   initiating a voice command with the call input device.

7. The method of claim 4, wherein selecting the second floor graphical object comprises at least one of:
   designating a user's desired destination landing;
   moving the first floor graphical icon to overlay the second floor graphical object;
   touching the second floor graphical object at least once with an object; and
   initiating a voice command with the call input device.

8. The method of claim 1, wherein the first floor graphical object comprises a suggested first floor graphical object suggested by the call input device.

9. The method of claim 1, wherein the second floor graphical object comprises a suggested second floor graphical object suggested by the call input device.

10. A system for making elevator calls comprising:
   an elevator system;
   a call input device, in communication with the elevator system; wherein the call input device includes a graphical user interface and software configured to:
   display a plurality of graphical objects on the graphical user interface; and
   initiate an elevator call by selecting at least one of the plurality of graphical objects; and
   wherein initiate an elevator call includes selecting a first floor graphical object, suggesting, by the call input device, at least one second floor graphical object, and selecting a second floor graphical object from the plurality of graphical objects based at least in part on the suggesting.

11. The system on claim 10, wherein the call input device comprises a mobile device.

12. The system of claim 10, wherein the graphical user interface comprises a touch screen display.

13. The system of claim 10, wherein each of the plurality of graphical objects are moveable.

14. The system of claim 13, wherein the software is configured to:
   initiate an elevator call by allowing a user to select a first floor graphical object and a second floor graphical object from the plurality of graphical objects; and
   create at least one trip graphical object; and
   allow the user to select the at least one trip graphical object.

15. The system of claim 14, wherein the first floor graphical object comprises a suggested first floor graphical object suggested by the call input device.

16. The system of claim 14, wherein the second floor graphical object comprises a suggested second floor graphical object suggested by the call input device.

17. The system of claim 14 or the method of claim 5, wherein the at least one trip graphical object is at least one of:
   based at least in part on selecting the second floor graphical object and/or comprises a suggested trip graphical object suggested by the call input device;
   and
   comprises a return trip graphical object.

18. The system of claim 14, wherein the software is further configured to detect the selection the first floor graphical object by allowing the user to at least one of:
   touch the first floor graphical object at least once with an object; and
   initiate a voice command with the call input device.

19. The system of claim 14, wherein the software is configured to detect the selection the second floor graphical object by allowing the user to at least one of:
   touch the second floor graphical object at least once with an object; and
   move the first floor graphical object to overlay the second floor graphical object.

20. The method of claim 19, wherein the software is configured to detect the selection of the trip graphical object by allowing the user to at least one of:
   touch the at least one trip graphical object at least once with an object; and
   initiate a voice command to select the at least one trip graphical object.

21. The method of claim 5, wherein the at least one trip graphical object:
   is based at least in part on selecting the second floor graphical object and/or comprises a suggested trip graphical object suggested by the call input device; and/or comprises a return trip graphical object.

* * * * *